US007414184B2

(12) United States Patent
Bryce

(10) Patent No.: US 7,414,184 B2
(45) Date of Patent: Aug. 19, 2008

(54) ALTERNATIVE TUNING DEVICE FOR STRINGED MUSICAL INSTRUMENTS

(76) Inventor: Alasdair James Bryce, 74 Branksome Dr. Shipley, Bradford (GB) BD18 4BE ( * ) Notice: Subject to any disclaimer, the term of this patent is extended or adjusted under 35 U.S.C. 154(b) by 0 days.

(21) Appl. No.: 11/605,117

(22) Filed: Nov. 29, 2006

(65) Prior Publication Data

US 2007/0131083 A1 Jun. 14, 2007

(30) Foreign Application Priority Data

Dec. 10, 2005 (GB) ..... 0525207.7

(51) Int. Cl.
*G10D 3/14* (2006.01)

(52) U.S. Cl. ..... 84/312 R; 84/313

(58) Field of Classification Search ..... 84/312 R, 84/313

See application file for complete search history.

(56) References Cited

U.S. PATENT DOCUMENTS

| | | | | | |
|---|---|---|---|---|---|
| 284,969 | A | * | 9/1883 | McIntosh | 24/71.1 |
| 1,531,458 | A | * | 3/1925 | Staples | 84/297 R |
| 1,577,245 | A | * | 3/1926 | Bua | 84/312 R |
| 1,638,432 | A | * | 8/1927 | Connors | 254/231 |
| 1,726,849 | A | * | 9/1929 | Martyn | 84/312 R |
| 1,957,367 | A | * | 5/1934 | Suydam | 188/196 M |
| 2,007,861 | A | * | 7/1935 | Hoyt | 84/312 R |
| 2,049,074 | A | * | 7/1936 | Mott | 24/71.1 |
| 2,226,085 | A | | 12/1940 | Weedin | |
| 2,234,218 | A | * | 3/1941 | Abrams | 84/312 R |
| 2,241,284 | A | * | 5/1941 | Walder | 84/312 R |
| 2,322,137 | A | * | 6/1943 | Jauch | 84/312 R |
| 2,336,818 | A | * | 12/1943 | Topinka | 24/71.1 |
| 2,344,052 | A | * | 3/1944 | Neale | 24/71.1 |
| 2,444,743 | A | * | 7/1948 | Melidoni | 24/71.1 |
| 2,893,282 | A | | 7/1959 | Searles | |
| 3,183,565 | A | * | 5/1965 | Schwarz | 24/71.1 |
| 3,739,680 | A | * | 6/1973 | Christiansen | 84/266 |
| 4,147,087 | A | * | 4/1979 | Peters et al. | 84/312 R |
| D265,171 | S | * | 6/1982 | Zukaitis | D8/44 |
| 4,643,069 | A | | 2/1987 | Borisoff | |
| 4,662,632 | A | * | 5/1987 | Bjorhn | 473/534 |
| 4,936,182 | A | * | 6/1990 | Bunker | 84/266 |
| 5,103,708 | A | | 4/1992 | Steinberger | |
| 5,359,144 | A | | 10/1994 | Benson | |

(Continued)

FOREIGN PATENT DOCUMENTS

| | | |
|---|---|---|
| GB | 154631 | 12/1920 |

(Continued)

OTHER PUBLICATIONS

The Story (Part II) Beacon Banjo presenting D-Tuner history http://beaconbanjo/story2.cfm, viewed Oct. 23, 2007, history details from 1957.*

(Continued)

*Primary Examiner*—Lincoln Donovan
*Assistant Examiner*—Robert W Horn

(57) ABSTRACT

A device which attaches to the non-vibrating part of specific string(s) of suitable stringed musical instruments and which enables the musician to repeatably apply alternative predetermined tension states to the string(s), so as to selectively apply a known increment in pitch without the continual need for discerning re-tuning processes.

7 Claims, 4 Drawing Sheets

U.S. PATENT DOCUMENTS

| | | | | |
|---|---|---|---|---|
| 5,442,987 | A | 8/1995 | Davis | |
| 5,585,580 | A * | 12/1996 | Higgins | 84/312 R |
| 5,623,751 | A * | 4/1997 | Knutson | 24/71.1 |
| 5,796,020 | A * | 8/1998 | Truitt | 84/266 |
| 6,080,921 | A * | 6/2000 | Cunningham | 84/266 |
| 6,515,207 | B1 | 2/2003 | Gregory | |
| 6,806,411 | B1 * | 10/2004 | Allen | 84/454 |
| 7,109,405 | B2 * | 9/2006 | Brown | 84/318 |
| 2004/0194609 | A1 | 10/2004 | Allen | |
| 2007/0131083 | A1 * | 6/2007 | Bryce | 84/313 |
| 2007/0187660 | A1 * | 8/2007 | Clark et al. | 254/243 |
| 2007/0240554 | A1 * | 10/2007 | Hany | 84/312 R |

FOREIGN PATENT DOCUMENTS

| | | | |
|---|---|---|---|
| GB | 540560 | A | 10/1941 |

OTHER PUBLICATIONS

Cheat-A-Keys D-Tuners, www.banjo.com/shopping/shopexd.asp?id=917, viewed Oct. 23, 2007.*

* cited by examiner

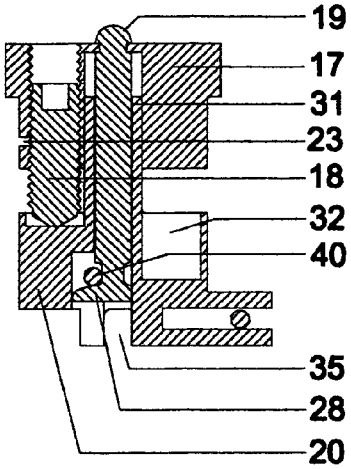
FIG.6
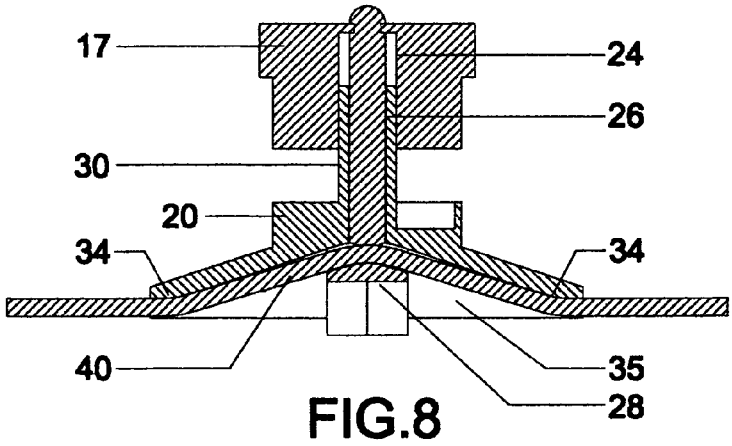
FIG.8
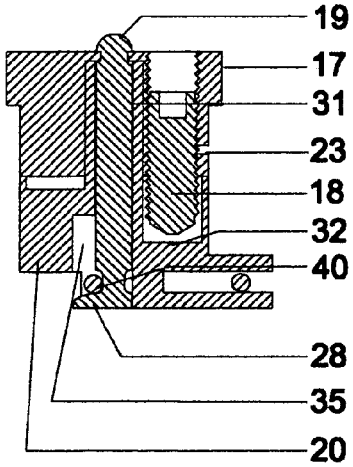
FIG.7
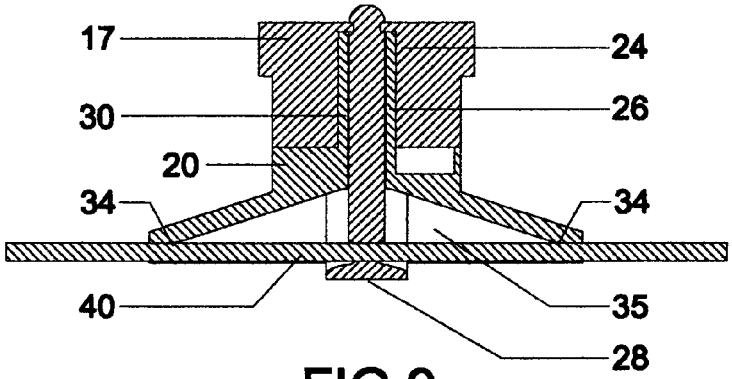
FIG.9
FIG.10
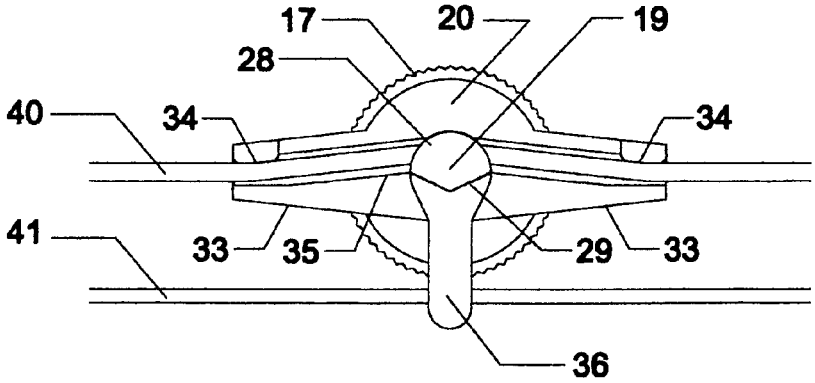

ALTERNATIVE TUNING DEVICE FOR STRINGED MUSICAL INSTRUMENTS

CROSS-REFERENCE TO OTHER RELATED APPLICATIONS

This application relates to and claims priority from GB Patent Application Number GB 0525207.7, filed on Dec. 10, 2005, disclosure of which is incorporated herein by reference.

BACKGROUND OF THE INVENTION

1. Field of the Invention

This invention relates to a means of easily applying alternative pre-determined tension states upon the strings of various types of fretted or unfretted stringed musical instruments such as electric guitars, acoustic guitars, bass guitars, lap-steel guitars, banjos and many others.

Stringed musical instruments, such as guitars, employ a plurality of strings which are anchored and tensioned so as to produce, when plucked, a corresponding series of open notes for which customary tunings have evolved. Such tunings are known to musicians and largely determine the fingering patterns for those strings so as to produce the desired combinations or progressions of notes.

Musicians may occasionally choose to alter the relative tuning of the strings for the purpose of expanding their musical capability. Conventionally, such alterations of pitch would involve readjusting the tension, and thus pitch, of the specific string(s) either by ear, or with the assistance of a tuning fork or electronic tuner. In order to avoid this critical readjustment process, various means of applying alternative pre-determined tension states upon the strings have been developed and are known in the prior art.

2. Description of the Related Art

Despite offering the benefits of applying alternative pre-determined tension states, the various devices known in the prior art all require installation of specialist equipment upon a given instrument so as to provide this function. For the purposes of this document, the word 'installation' is taken to mean an attachment process which, at the very least, requires a string to be de-tensioned and released from the instrument but may also mean the requirement for the use of a tool and may further mean the requirement for some modification to the host instrument, such as the drilling of a hole for example. Installation is thus undesirable because: it may be time-consuming and inflexible; it may require the use of specialist tools or skill, and; it may impair the host instrument in such a way that it can not be returned to it's original condition.

Similarly, the devices known in the prior art may only be suitable for certain types or models of instrument, may be limited in use to designated strings, may be rather obtrusive when fitted or, may introduce tuning instability in service.

Accordingly, it is the object of this invention to provide a means of repeatably applying alternative pre-determined tension states upon the strings of suitable musical instruments: which requires no installation upon the host instrument; which may be readily fitted and removed as preferred; which may be used on virtually any type or model of instrument; which may be used on any string, or multiples of strings, and; which would be unobtrusive when in use.

BRIEF SUMMARY OF THE INVENTION

To achieve the foregoing objects, the present invention comprises of a device which: attaches solely to the string(s) at a point beyond either the nut or the bridge of the instrument; may be readily detached from said string(s); may attach to any preferred string(s); may be used in multiples over a number of strings, and which; may provide a repeatable incremental pitch change purely by means of it's engagement upon the string(s).

The fact of locating such a device purely upon the string(s) facilitates a universal application in that whereas virtually all design attributes vary between different instruments, models and manufacturers, the strings must essentially be the same. By providing for rapid attachment and detachment of the device, the musician may apply predetermined tension/pitch states to any string of any instrument instantly.

BRIEF DESCRIPTION OF THE SEVERAL VIEWS OF THE DRAWING

FIG. 6 is a sectional view taken upon line 2-2 showing the invention in the high-tension state;

FIG. 7 is a sectional view taken upon line 2-2 showing the invention in the low-tension state;

FIG. 8 is a sectional view taken upon line 1-1 showing the invention in the high-tension state;

FIG. 9 is a sectional view taken upon line 1-1 showing the invention in the low-tension state;

FIG. 10 is a view taken upon arrow 3 showing the underside of the invention, shown relative to an attached string and an adjacent string.

DETAIL DESCRIPTION OF THE INVENTION

Figure 1:
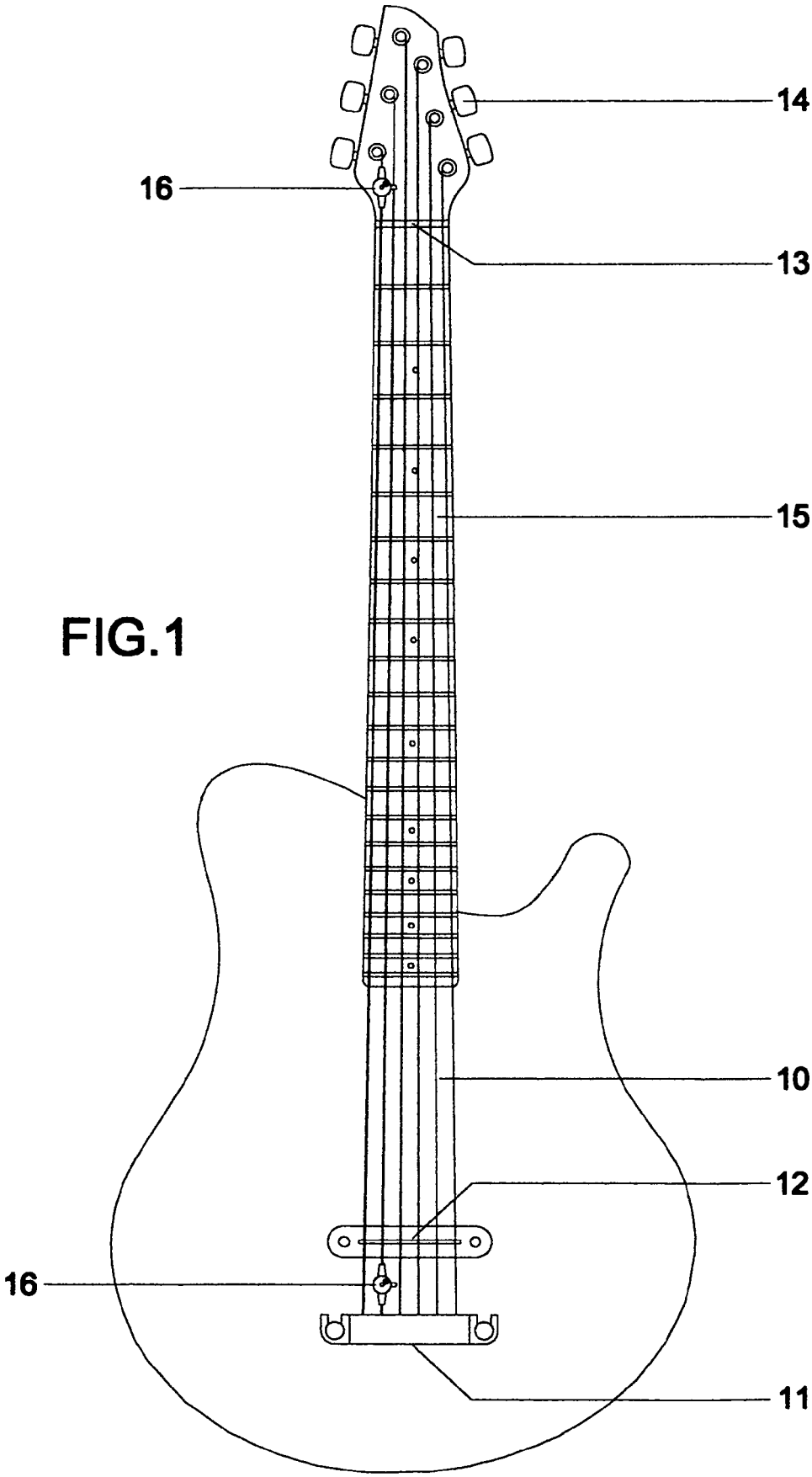
FIG. 1 is a plan view of a generic stringed musical instrument showing the two possible attachment points for the invention.

Referring in detail to the drawings, FIG. 1 illustrates a stringed musical instrument wherein a plurality of strings (generally) 10 are anchored at tailpiece 11, pass over bridge 12, extend longitudinally over finger-board 15, pass over nut 13 and are then anchored upon tuning machines 14. Tuning machines 14 are manually operable so as to provide fine control over the tension of the string thereby enabling the musician to 'tune' the instrument. Bridge 12 and nut 13 constitute breakpoints which define the scale-length of the vibrating part of the string which is manipulated by the musician during performance. The lengths of string between: the tailpiece 11 and bridge 12, and; the nut 13 and tuning machine 14, exist due to the need to anchor and tension the ends of the string independently from defining the playable scale-length. It can be understood, therefore, that a device fitted to either of these two parts of the string could affect the tension, and thus pitch, of the playable part of the string, without causing interference or obstruction. Such a device (16) is shown fitted in both of these locations and represents an embodiment of the present invention.

Figure 2:
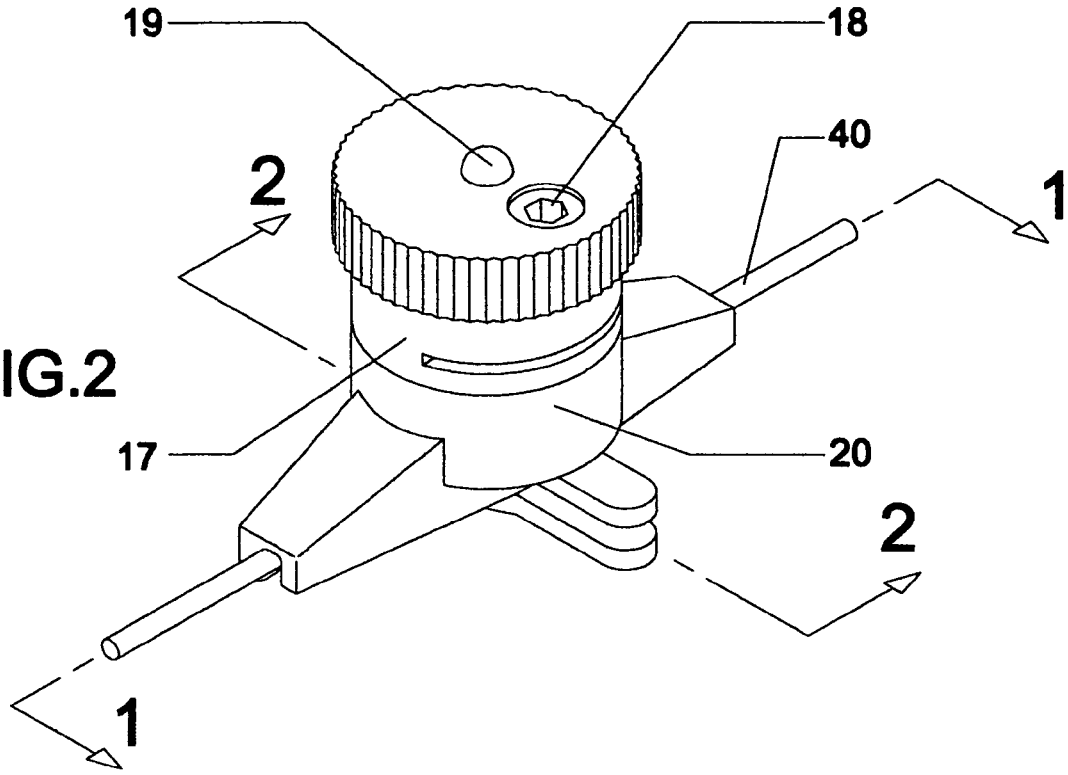
FIG. 2 is an isometric view of the invention as attached to one string, as seen generally from above.

FIG. 2 illustrates the assembled device and shows the relative arrangement of body 20, thumbwheel 17, piston 19, set-screw 18 and string 40.

Figure 3:
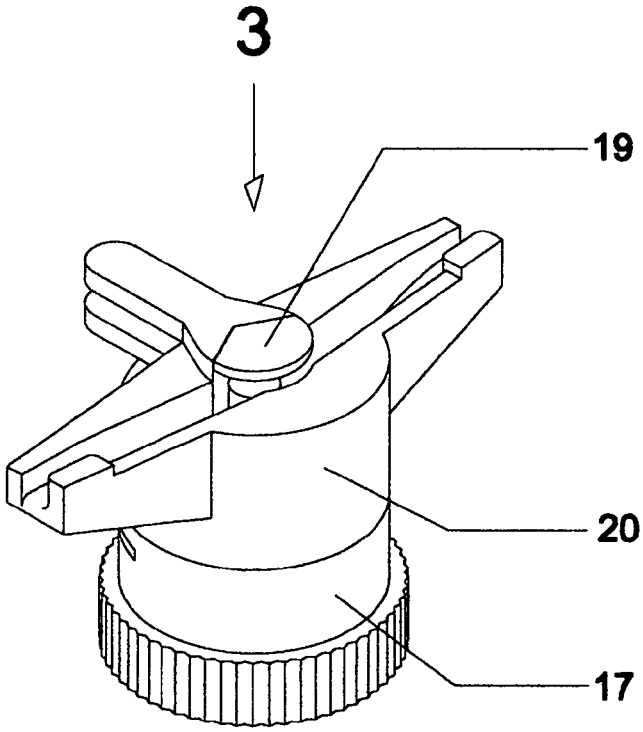
FIG. 3 is an isometric view of the invention shown in isolation, as seen generally from below.

FIG. 3 also illustrates the assembled device and shows body 20, thumbwheel 17 and piston 19.

Figure 4:
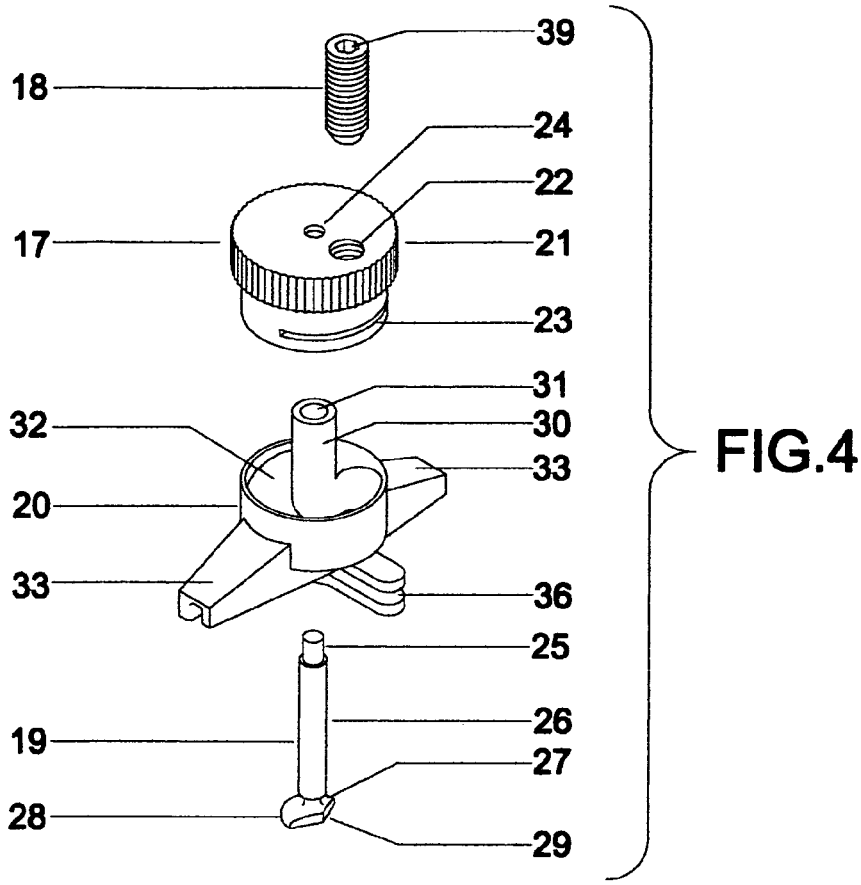
FIG. 4 is an isometric exploded view of the invention, as seen generally from above.

With reference to FIG. 4, thumbwheel 17 is a cylindrical component adapted with a protruding knurled flange 21, tapped hole 22, slit 23 and counter-bored hole 24. It is envisaged that this component would be turned from brass and plated to the desired finish. Set-screw 18 is a proprietary high tensile steel set screw with a typical hexagonal recess 39 to accept corresponding hexagonal key means of rotation. Piston 19 is essentially a shaft adapted with shank 26, reduced shank 25 at one end, and further adapted with a reduced diameter neck 27 and protruding flange 28, with machined facets 29, at the opposite end. It is envisaged that this component would be turned from stainless steel. Body 20 is adapted with a raised collar 30 and concentric hole 31, about which helical channel 32 is orientated. Body 20 is further adapted with protruding arms 33 and with a transverse-facing protrusion 36. It is envisaged that body 20 would be produced in stainless steel as a metal injection moulding. This process will provide the level of definition and finish necessary for a part of these compact dimensions and it will also enable the use of a material of appropriate surface hardness. The invention is assembled by means of locating the shank 26 of piston 19 through the concentric hole 31 of body 20 and into the counter-bored hole 24 of thumbwheel 17, at which point the reduced shank 25 is flared by means of a staking operation, thus making the assembly captive. Finally, set-screw 18 is located into tapped hole 22 of thumbwheel 17 and is held tight by means of an interference generated by the prior closure about slit 23.

Figure 5:
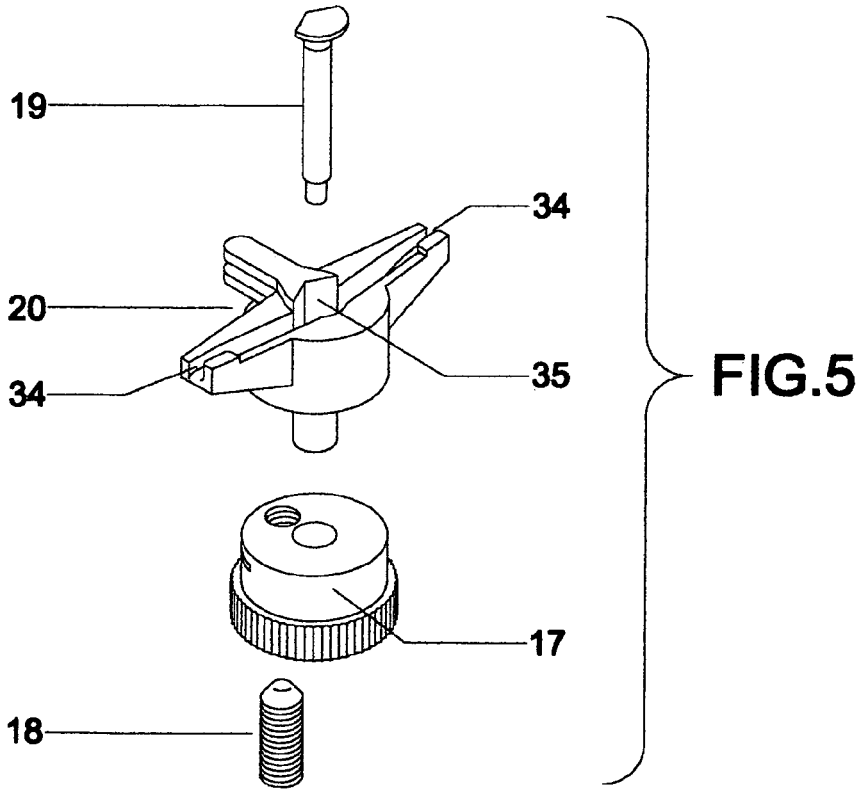
FIG. 5 is an isometric exploded view of the invention, as seen generally from below.

FIG. 5 also shows body 20, thumbwheel 17, piston 19 and set-screw 18, whilst also illustrating guide forms 34 and general cavity form 35 of body 20.

With reference to FIG. 6 and FIG. 7, the principle function of the invention involves the longitudinal travel of piston 19 through concentric hole 31 of body 20. It can be understood that as the piston rises, flange 28 displaces and thus elongates string 40 resulting in an increase in tension which causes a corresponding rise in pitch from the vibrating part of the string. This effect can be understood by comparing FIG. 7, which illustrates the invention in the low-tension state, with FIG. 6 which illustrates the invention in the high-tension state and at the extent of it's travel, where string 40 is fully displaced into corresponding cavity form 35. The longitudinal travel of piston 19 is achieved by means of the rotation of thumbwheel 17. Set-screw 18 protrudes from the underside of thumbwheel 17 and locates into helical channel 32. Helical channel 32 is essentially 'C' shaped in plan, thus restricting set-screw 18 to nominally 270 degrees of rotation. Helical channel 32 is further adapted so that it's bottom surface gradually rises in the form of a partial helix. Consequently, as thumbwheel 17 is rotated, the engagement of set-screw 18 upon helical channel 32 causes thumbwheel 17 to rise and thus piston 19 rises accordingly. Fine control over the extent of travel of piston 19 is of critical importance and allows a specific change in tension to be applied to the string. In practice, strings of different gauges will offer a different pitch change to a given piston travel and musicians may desire differing pitch changes for a particular effect. For this reason, the invention may be calibrated to provide a specific pitch change when used with a specific gauge of string. Such calibration is achieved by the adjustment of set-screw 18. With reference to FIG. 7, it can be understood that when the invention is set in the low-tension state, set-screw 18 does not make contact with helical channel 32 and, in this position, thumbwheel 17 engages upon body 20. As thumbwheel 17 is progressively rotated, set-screw 18 will make contact with helical channel 32 at a point dependant upon it's protrusion from the underside of thumbwheel 17. Thus, in the high-tension state, the extent of travel of piston 19 is determined solely by the adjusted setting of set-screw 18, as illustrated in FIG. 6. In order to prevent any unwanted rotation of set-screw 18 during use, thumbwheel 17 is adapted with slit 23 which, by means of it's partial closure prior to assembly, creates an interference fit to the thread of set-screw 18, thus acting in the manner of a locknut. In use, when the invention is set in the low-tension state, the string of the host instrument is tuned to the lower of the two pitches by way of it's own tuning machine. Then, when the invention is set in the high-tension state, the string is tuned to the higher of the two pitches by means of set-screw 18. After this setting up exercise, either of the two pitches can immediately be selected simply by rotating thumbwheel 17.

FIG. 8 and FIG. 9 illustrate that the points of the device which contact the string are adapted with smooth and radiused surfaces so as to minimise friction and also to prevent any permanent deformation to the string 40. Hence, guide forms 34 and protruding flange 28 are produced with a smooth surface finish and are shaped in sympathy with the path of the string in the high-tension state. Similarly, general cavity form 35 of body 20 is profiled so as to accept the string 40 in it's fully displaced state. The proportionate upward projection of raised collar 30 co-operates with shank 26 and counter-bored hole 24 to ensure that thumbwheel 17 remains axially true during travel and, hence, free from any unwanted play and the resultant inconsistency which that would cause.

FIG. 10 shows how the invention locates onto the designated string 40 at the two outer guide forms 34 of body 20, and below flange 28 of piston 19. These three points effectively apply a slight deviation to the string. FIG. 10 also indicates how the invention could be fitted simply by momentarily reducing tension in the string so that it could be slipped over the protruding flange 28, at which point re-tensioning of the string will serve to hold the invention positively. Because piston 19 is adapted with machined facets 29 which engage into general cavity form 35, no rotational movement is transferred from thumbwheel 17 to piston 19 during operation. FIG. 10 further indicates the function of transverse facing protrusion 36 of body 20 which locates over an adjacent string 41 so as to prevent any axial rotation about the designated string when the invention is being operated. In this case such a location is loose and non-bearing so as avoid any friction during relative travel of the designated and adjacent strings. Protruding arms 33 to body 20 are adapted in tapering, skeletal form so as to avoid contact with adjacent strings where the design of the instrument is such that the strings may converge as they pass from the nut to their individual tuning machines. This tapering, skeletal form would also allow the invention to be used in multiples over a number of strings, in close proximity.

Because of the differing gauges of string in use on various stringed musical instruments, it is foreseeable that a number of different variants of the invention may be required. Whereas the strings commonly used on many instruments such as electric guitars, acoustic guitars, pedal steel guitars and banjos are generally comparable, the strings used on other instruments such as bass guitars are of considerably heavier gauge. Thus, specific variants of the invention may be adapted with differing travel/calibration characteristics to suit specific instrument groups.

The above description illustrates the technical attributes of an embodiment of the invention and describes the means of repeatably applying alternative tension states upon the strings of a wide variety of stringed musical instruments whereby simplicity of attachment and removal, operational adaptability and scope of compatibility exceed those of the examples known in the prior art.

The foregoing disclosure has been set forth merely to illustrate the invention and is not intended to be limiting in either application or embodiment. For example, the invention may also be embodied in such a way that a plurality of strings are affected, if it's function is equivalent. As a further example, the invention may also be embodied with friction-reducing rollers/materials at the contact points. Additional modifications which occur to those skilled in the art may differ from those disclosed herein without departing from the spirit or scope of the inventive concept as defined by the appended claims and their equivalence.

What is claimed is:

1. An auxiliary device for applying alternative predetermined tension states upon the string(s) of various types of stringed musical instruments comprising:

main body, said main body to engage upon said string(s) at two longitudinally opposing outer points, said main body to have clearance for said string(s) to be deflected between said outer points;

control handle, said control handle to incorporate diametrically opposing surfaces about an axis of rotation, said diametrically opposing surfaces to receive concurrent manual force during operation, said control handle to have a rotational freedom of movement limited to no more than one full turn by means of at least two clearly discernable stop points;

actuator, said actuator to deflect said string(s) at a point in between said outer points of said main body, said actuator to deflect said string(s) in accordance with the rotation of said control handle;

calibration control, said calibration control to critically pre-determine the extent to which said actuator deflects said string(s) between said outer points of said body in accordance with the rotation of said control handle;

wherein, rotation of said control handle from one said stop point to another said stop point causes said actuator to deflect said string(s) against said outer points of said main body to an extent pre-defined by said calibration control whereupon the device will apply a different tension state upon the string(s) at either stop point and whereupon the difference between said tension states will produce an interval in pitch of at least one semi-tone upon the vibrating string(s), and wherein, the manual force applied to said control handle to drive the device between the tension states applied to said string(s) will be in the form of a couple, the pure rotational force of which has no tendency to displace the device along said string(s) nor to cause angular deviation to those lengths of said string(s) which are adjacent to the device during operation, and wherein, the device is accordingly capable of stable single-handed operation without relying upon physical contact with any other part of the host instrument except said string(s).

2. An auxiliary device for applying alternative predetermined tension states upon the string(s) of various types of stringed musical instruments, as in claim 1, but wherein, the string bearing surface of said actuator projects into the line which connects the string bearing surfaces of said two outer points of said main body such that an initial plane of deviation is defined by those three points of contact upon said string(s), and wherein, the normal travel of said actuator lies upon an axis which is substantially perpendicular to said initial plane of deviation, and wherein, said initial plane of deviation exploits the tendency of said string(s) to stay taut and straight under tension for the purpose of securely locating the device upon said string(s) and whereupon said substantially perpendicular travel of said actuator applies tension variation for the purpose of creating a recognisable pitch variation in use.

3. An auxiliary device for applying alternative predetermined tension states upon the string(s) of various types of stringed musical instruments, as in claim 1, but wherein, said actuator travels substantially perpendicularly to said string(s) in a piston-like action, and wherein, said calibration control comprises of a screw thread element whereupon said screw thread element drives said piston-like action of said actuator in accordance with the rotation of said control handle, and wherein, the extent of adjustment of said screw thread element defines the high tension displacement state of said actuator, and wherein, the effective stroke length of said actuator is ¼" or less, and wherein, by way of rotating said control handle, the device would repeatably apply a semi-tone interval when said screw thread element is adjusted to near one end of it's travel and whereupon the device would repeatably apply a whole-tone interval when said screw thread element is adjusted further towards the other extreme of it's travel.

4. An auxiliary device for applying alternative predetermined tension states upon the string(s) of various types of stringed musical instruments, as in claim 1, but wherein, said device is orientated upon said string(s) such that said control handle is presented to the front side of said string(s) and whereupon the body of the host instrument resides substantially to the reverse side of said string(s), and wherein, said longitudinally opposing outer points of said main body protrude beyond the reverse side of said string(s) so as to offer secure engagement to said string (s) and whereupon said protrusion does not exceed ⅛" below the centre line of said string(s), and wherein, said actuator is located generally to the front side of said string(s) whereupon the travel Of said actuator deflects the string frontally and away from said host instrument, and wherein, no other part of the device protrudes more than ⅛" to the reverse side of said string(s), thus avoiding physical contact between the device and any other part of said host instrument except said string(s).

5. An auxiliary device for applying alternative predetermined tension states upon the string(s) of various types of stringed musical instruments, as in claim 1, but wherein, the device is fitted to a single operative string which is in relatively close proximity to another laterally adjacent string, and wherein, said main body further includes protrusions which are orientated substantially perpendicularly to said operative string, said protrusions extending towards said adjacent string whereupon said protrusions do not fully enclose said adjacent string but engage loosely on opposing surfaces of said adjacent string thus preventing the device from rotating axially upon the operative string and thereupon maintaining consistent orientation of the device in service.

6. An auxiliary device for applying alternative predetermined tension states upon the string(s) of various types of stringed musical instruments, as in claim 1, but wherein, the device is fitted to a single operative string which is in relatively close proximity to other laterally adjacent string(s), said adjacent string(s) may be parallel to said operative string, or angularly inclined towards said operative string, and wherein, said main body extends laterally towards said adjacent strings but narrows considerably towards at least one of said outer points of said main body resulting in a tapering outline to said main body, and wherein, the edge of said tapering outline substantially corresponds with the line of said angularly inclining adjacent string so that physical contact between said device and said angularly inclining adjacent string is avoided.

7. A device for applying alterative predetermined tension states upon the string(s) of various types of stringed musical instruments comprising:

a rotary control knob, said rotary control knob incorporating concentric hole therethrough, said control knob incorporating an axially parallel threaded hole therethrough;

an axial slider rod, said axial slider rod to incorporate lower location form to engage upon said string, said axial slider rod to cooperate with said concentric hole in said rotary control knob, said axial slider rod to incorporate upper flange means to bear upon said rotary control knob;

an adjustment screw, said adjustment screw to engage positively by screw thread means with said axially parallel threaded hole in said rotary control knob, said adjustment screw to be rotatably adjustable within said axially parallel threaded hole of said rotary control knob whereupon said adjustment will control the outward projection of the tip of said adjustment screw from said rotary control knob;

a body, said body to incorporate outer points for engagement upon said string, said main body to incorporate a cavity area to provide for displacement of said string between said outer engagement points, said main body to incorporate central hole therethrough to co-operate with said axial slider rod, said main body to incorporate inclining surface for co-operation with the tip of said adjustment screw, and wherein, said string locates upon said outer engagement points of said main body and may then be displaced at a point between said outer engagement points by means of the engagement of said lower location form of said axial slider rod whereupon said axial slider rod rises as said upper flange means bears upon said rotary control knob wherein the ultimate displacement is defined by the extent of projection of the tip of said adjustment screw according to it's travel upon said inclining surface of said main body.

* * * * *